US005558430A

United States Patent [19]

Booty, Jr.

[11] Patent Number: 5,558,430

[45] Date of Patent: Sep. 24, 1996

[54] DUAL BEAM FLASHLIGHT

[75] Inventor: Donald J. Booty, Jr., Chicago, Ill.

[73] Assignee: Phorm Concept and Design, Inc., Chicago, Ill.

[21] Appl. No.: 355,252

[22] Filed: Dec. 9, 1994

[51] Int. Cl.[6] ..... F21L 1/00

[52] U.S. Cl. ..... 362/184; 362/190; 362/199; 362/205

[58] Field of Search ..... 362/184, 190, 362/191, 197, 199, 205, 208, 238, 239

[56] References Cited

U.S. PATENT DOCUMENTS

| | | | |
|---|---|---|---|
| 2,329,556 | 9/1943 | Raabe | 362/191 |
| 2,509,832 | 5/1950 | Miller | 362/197 |
| 2,581,129 | 1/1952 | Muldoon | 362/184 |
| 2,593,784 | 4/1952 | Nyberg | 362/197 |
| 2,966,580 | 12/1960 | Taylor | 362/184 |
| 4,203,150 | 5/1980 | Shamlian | 362/202 |
| 4,215,389 | 7/1980 | Colangelo | 362/199 |
| 4,218,637 | 8/1980 | Zelina, Jr. | 362/184 |
| 4,459,646 | 7/1984 | Drane | 362/199 |
| 5,077,644 | 12/1991 | Schaller et al. | 362/184 |
| 5,097,399 | 3/1992 | Gammache | 362/197 |
| 5,180,050 | 1/1993 | Rada et al. | 200/329 |
| 5,217,297 | 6/1993 | Yuen | 362/184 |

FOREIGN PATENT DOCUMENTS

| | | | |
|---|---|---|---|
| 2118290 | 10/1983 | United Kingdom | 362/184 |

*Primary Examiner*—Denise L. Gromada
*Assistant Examiner*—Alan B. Cariaso
*Attorney, Agent, or Firm*—Richard C. Litman

[57] ABSTRACT

A dual beam flashlight has a primary fixed headlamp and a recessed rotatable secondary lamp energized only in the rotated position. Each lamp has its own energizing system to enable a user to utilize either lamp separately or to have both lamps illuminated.

20 Claims, 3 Drawing Sheets

10
12
14
16
18
20
22
24
30
32
34
36
36
36
38
40
41
41
46

FIG. 3
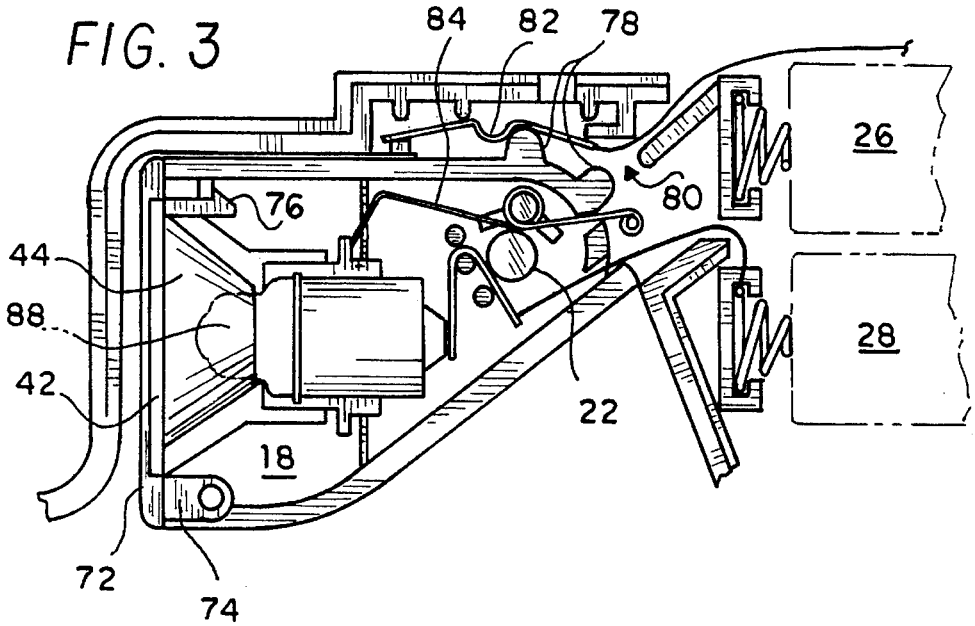
FIG. 4
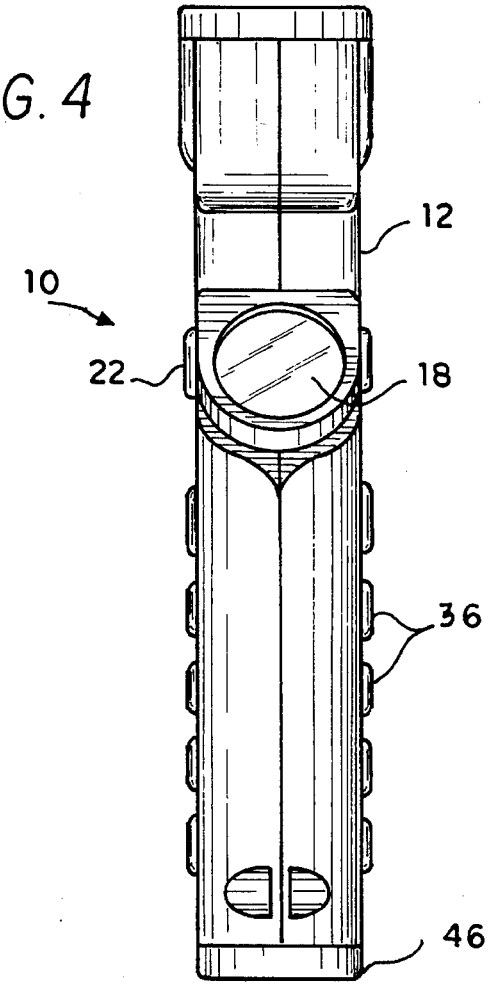
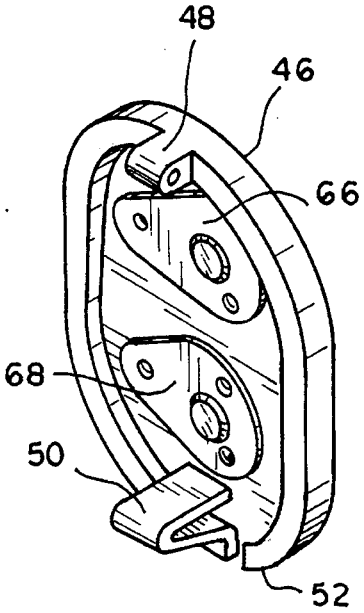
FIG. 5

DUAL BEAM FLASHLIGHT

BACKGROUND OF THE INVENTION

1. Field of the Invention

The present invention relates to a dual beam, hand held flashlight having a fixed primary headlamp in a longitudinal body and a secondary lamp housed in a separate rotatable housing positioned in a recess of the longitudinal body. Each lamp has its own energy source and switch. The recessed lamp is normally off in the recessed position and energized only when rotated out from the recess. The flashlight can be used for walking with both beams on or reading a map or the like in a vehicle with only the rotated beam.

2. Description of the Prior Art

A number of patents have been issued that disclose dual beam flashlights. These patents will be discussed in the order of their perceived relevance.

In U.S. Pat. No. 4,459,646 issued on Jul. 10, 1984 to John H. Drane, a pivotable head portion positioned at one end of a flashlight body and pivoted out to energize the single lamp at various angles up to the perpendicular is disclosed. The switch is internal. A variety of plastic materials can be utilized for the casing.

In U.S. Pat. No. 4,215,389 issued on Jul. 29, 1980 to Colangeo, a frame containing two batteries aligned in a V-shaped position with a naked rotating bulb positioned at the open end is disclosed. The bulb is energized when rotated out. The framed light system may further be encased in a clipped case for attachment to apparel.

In U.S. Pat. No. 5,077,644 issued on Dec. 31, 1991 to David R. Schaller et al., a hand held flashlight containing two bulbs having individual reflectors to generate a spot beam for illuminating distant objects and a flood beam for illuminating near objects is disclosed. There is no provision for rotation of either bulb.

In U.S. Pat. No. 5,217,297 issued on Jun. 8, 1993 to John Yuen, a combined incandescent and fluorescent lantern having the incandescent bulb at one end of a body and a fluorescent tube rotating out up to 180 degrees from the other end of the body is disclosed. The control switch 9 apparently controls both bulbs simultaneously. There is provision for a jack through socket 10 which enables recharging the battery or illuminating either bulb from an external source. However, a separate energizing source for each bulb is not disclosed.

In U.S. Pat. No. 5,097,399 issued on Mar. 17, 1992 to Richard J. Gammache, a flashlight with a swivel head containing a spare bulb is disclosed.

Finally, in United Kingdom patent application 2,118,290 A published on Oct. 26, 1983 for Victor S. Basnayake, a five-cell flashlight having two forward bulbs and two rear bulbs is disclosed. The second forward bulb is located perpendicular to the first forward bulb to illuminate the ground. The third bulb is directed backwards as a tail light. The fourth bulb can be a flashing bulb. The multi-position switch has four positions. There is no provision for rotation of any bulb.

None of the above inventions and patents, taken either singly or in combination, is seen to describe the instant invention as claimed.

SUMMARY OF THE INVENTION

Accordingly, it is a principal object of the invention to provide a hand held and dual beam flashlight having separate energizing systems.

It is another object of the invention to provide a dual beam flashlight wherein the primary headlamp is facing forward in a fixed position and the secondary lamp is rotated downward.

It is a further object of the invention to provide the secondary lamp with a separate switch which energizes the secondary lamp only when rotated out from a recess in the body of the flashlight.

Still another object of the invention is to provide a flashlight usable for walking or reading materials in a vehicle.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a magnified, enlarged scale view of the rotatable secondary lamp of FIG. 2 in an "off" position.

FIG. 4 is bottom view of the dual beam flashlight with the rotatable secondary lamp in an "on" position.

FIG. 5 is a rear (inside) view of the end cap or battery compartment cover.

Similar reference characters denote corresponding features consistently throughout the attached drawings.

DETAILED DESCRIPTION OF THE PREFERRED EMBODIMENT

Figure 1:
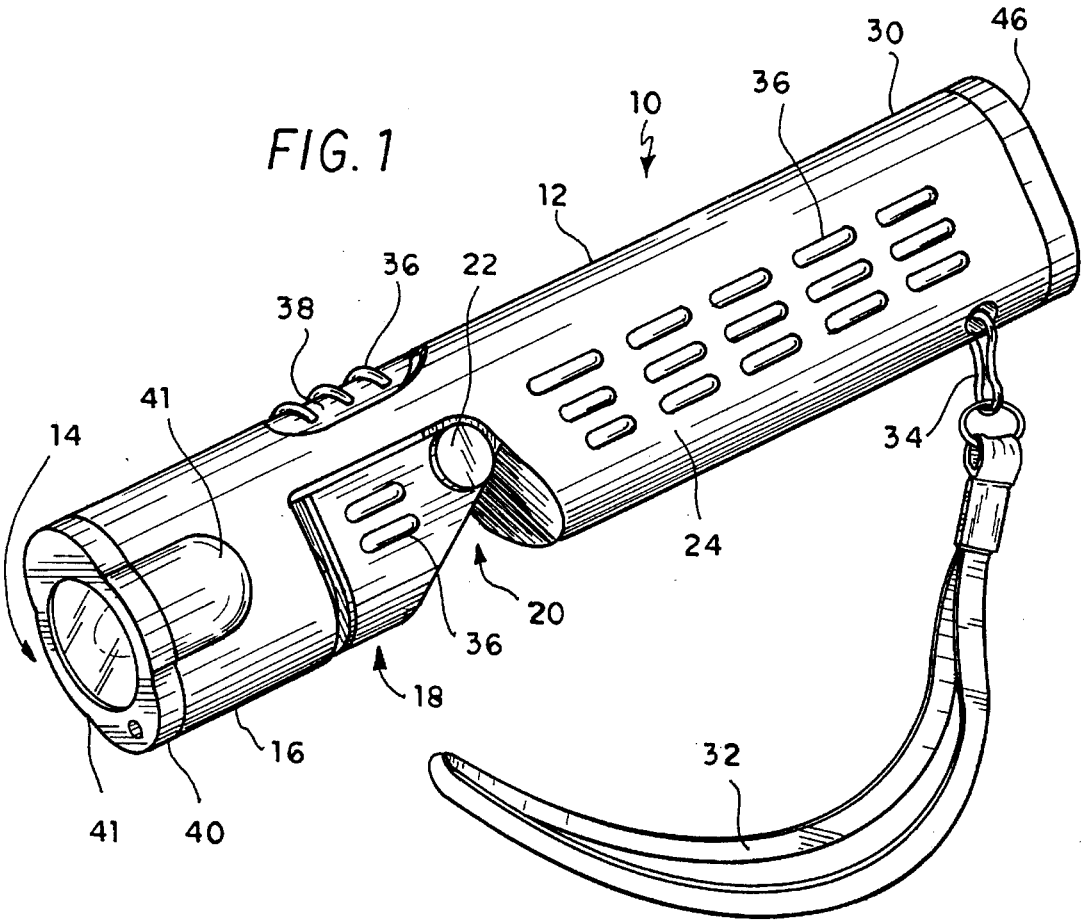
FIG. 1 is perspective view of the dual beam flashlight with the unlit rotatable lamp protected in its recess.
Figure 2:
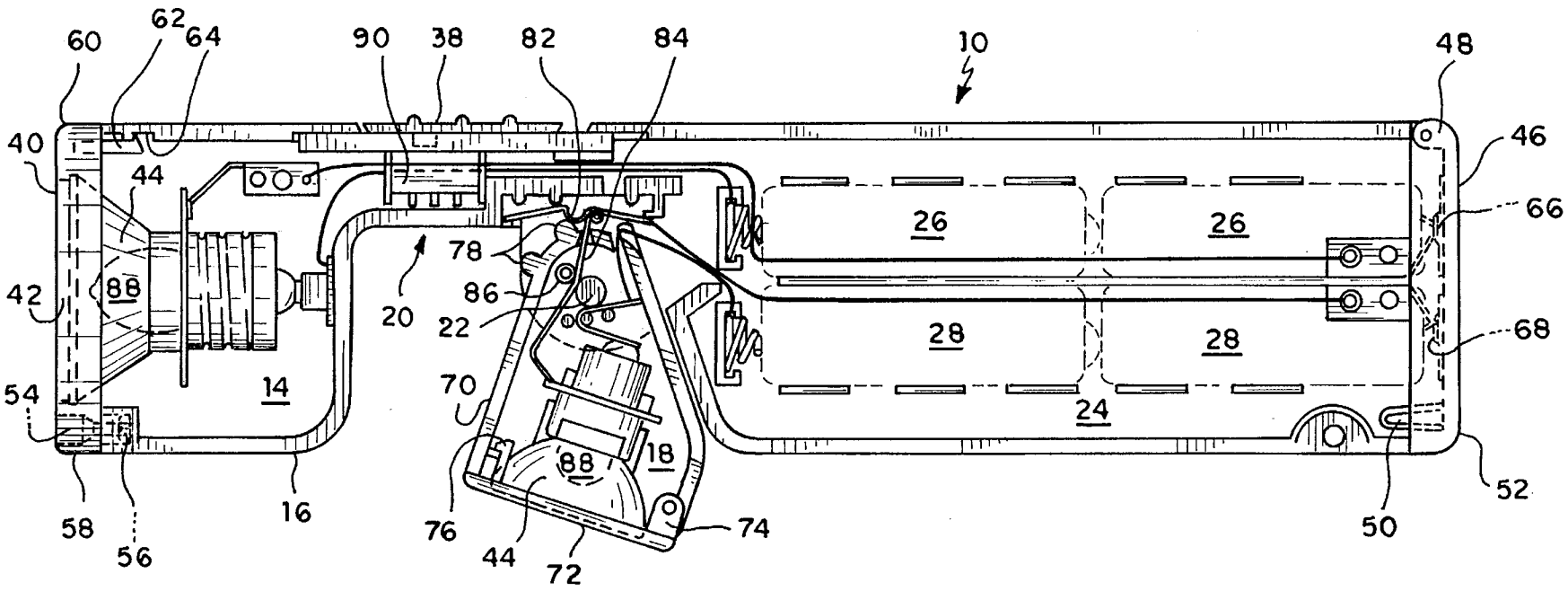
FIG. 2 is a side view of a half-section of the right half of the dual beam flashlight with the front lens cover and the end cap intact, and the lit rotatable lamp rotated out from its recess.

In FIG. 1, the present invention is illustrated, this being a dual beam flashlight 10 having a longitudinal body 12 with a fixed primary headlamp 14 at a front end 16. A secondary rotatable lamp 18 proximate to the front end 16 is positioned in recess 20 and pivots about axis 22 in a limited arc up to approximately 65°. Battery compartment 24 has two sections. As is seen in FIG. 2, the upper section is the first energizing source 26 (FIG. 2) for headlamp 14 and the lower section is a second energizing source 28 for the secondary rotatable lamp 18. Returning to FIG. 1, at the rear end 30, a detachable wrist strap cord 32 having a clip 34 is provided for the convenience of portability of the flashlight 10. A series of ridges 36 are located on both lateral sides of the longitudinal body 12 and the rotatable lamp 18 to enhance the user's grip on these parts. It is advantageous to provide similar ridges 36 on slide member 38. In FIG. 1, slide member 38 has been pushed forward to illuminate the primary headlamp 14, whereas the recessed rotatable lamp 18 is not illuminated.

FIG. 2 illustrates the right half of the flashlight body 12 having the headlamp lens cover 40 confining lens 42 and reflector 44 and the end cap 46 shown as unitary pieces. The rear end 30 of the flashlight body 12 has a hinge 48 for end cap or battery compartment cover 46 for providing access to the four AA batteries (shown in dashed outline) positioned two batteries to a section of the battery compartment 24. A depressible lock 50 or the like fastener at the bottom edge 52 permits the opening of the battery compartment 24. The secondary rotatable lamp 18 is rotated out from recess 20 as depicted in FIGS. 2 and 4.

Headlamp lens cover 40 of the primary headlamp 14 is detached by removing a threaded bolt 54 from a captive nut 56 located near the bottom edge 58 of lens cover 40. Near the top edge 60 of lens cover 40, two flexible hooks 62 (only one is illustrated in the right half of body 12) are disengaged from a slot 64 in the inside of the flashlight body 12.

FIG. 5 illustrates the positions of battery contact plate 66 for the first energizing source 26 and battery contact plate 68 for the second energizing source 28 on the inside of end cap or battery compartment cover 46.

In FIGS. 2 and 3, the rotatable lamp 18 encased in housing 70 has a removable lens cover 72 which is provided with a hinge 74 on the bottom and two flexible hooks 76 at the top (only one is shown). Two knobs 78 are located at the upper edge 80 of housing 70 and engage M-shaped contact strip 82 to serve as temporary stops for the rotatable housing 70. The forwardly positioned knob 78 serves to maintain the housing 70 in a closed position in recess 20. The other knob 78 serves to maintain housing 70 in an open position abutting the body 12. M-shaped contact strip 82 is electrically connected (positive or plus line) to the secondary energizing source 28. Spring contact 84 positioned on post 86 completes the secondary electrical circuit when it contacts the M-shaped contact 82 as shown in FIG. 2. Therefore, as the rotatable housing 70 is rotated out by pivoting about pivot axis 22, secondary rotatable lamp 18 is not energized until the free rounded end of the spring contact 84 contacts the M-shaped contact strip 82 at an angle approximately 65° down from the closed position.

The lamp 18, when lit in the manner as aforesaid, is fully exposed to light the ground in front of the user's feet or to illuminate a map or the like in a vehicle permitting an ergonomically correct position for the user's hand and wrist. Since the rear end 30 of flashlight body 12 is flat, the flashlight 10 can stand upright for hands-free use. Flashlight bulbs 88 are preferably energy-efficient krypton bulbs which emit bright light assisted by reflector 44 (see FIGS. 2 and 3). When the user utilizes the fixed primary headlamp 14, the user will push the slide member 38 forwardly, activating the switch 90 to energize the headlamp 14 from the first energizing source 26, as can be readily appreciated from an inspection of FIG. 2.

By way of example, the dual beam flashlight has the following approximate dimensions: length=7¾ in. or 19.8 cm.; width=1 ⅜ in. or 3.5 cm. at the front end, measured across and including the bulges 41, 41, and 1⅛ in. or 2.86 cm. throughout the major length of the flashlight, rearwardly of bulges 41, 41; height=1 ¾ in. or 4.4 cm.; and length of rotatable lamp housing=1 9/16 in. or 4 cm. Larger or smaller sized batteries would necessitate respective sizes of body 10 to accommodate the difference in battery size.

Three alternative uses of this dual beam flashlight are contemplated as follows: (1) the primary headlamp 14 can be utilized alone; (2) the secondary rotatable lamp 18 can be utilized alone; and (3) both lamps 14 and 18 can be utilized together when circumstances necessitate the use of both lamps. As noted above, the flashlight 10 can be positioned on its rear end 30 with either or both lamps illuminated.

The important advantage of this dual beam flashlight is that the rotatable secondary lamp 18 is in the "off" position and its lens 42 is protected when lamp 18 is retracted and positioned in the recess 20 of the flashlight body 12. Moreover, with two separate energizing sources 26, 28, there is a greater margin of safety when one of the energizing systems fails.

The flashlight body 12 is predominately made from plastic polymers selected from the list enumerated in U.S. Pat. No. 4,459,646, incorporated herein by reference. However, a blackened acrylonitrile-butadiene-styrene polymer is the preferred flashlight body material. The lenses for both lamps are preferably made from an acrylic polymer. The reddish colored slide 38 is preferably made from a polycarbonate polymer.

It is to be understood that the present invention is not limited to the sole embodiment described above, but encompasses any and all embodiments within the scope of the following claims.

I claim:

1. A dual beam flashlight comprising:

a flashlight body comprising a primary headlamp, a rotatable secondary lamp in a housing, a recess for the rotatable secondary lamp and housing, a first light switch, a second light switch, a first energizing source, and a second energizing source;

the primary headlamp being located at a front end of the flashlight body and fixed in said flashlight body, said flashlight body having a top region and a bottom region;

the rotatable secondary lamp being encased in the housing which is rotatable, said housing being positioned completely in the recess in said bottom region and proximate to the front end of said flashlight body;

the first light switch positioned in the top region of the flashlight body, energizing only the primary headlamp from the first energizing source; and the second light switch energizing the secondary lamp only by the second energizing source when said secondary lamp in said housing is rotated out from the recess; whereby a user of said dual beam flashlight can illuminate darkened areas from the lamps of the dual beam flashlight selected from the fixed primary headlamp, the rotatable secondary lamp, and both the fixed primary headlamp and the rotatable secondary lamp.

2. The dual beam flashlight according to claim 1, wherein the rotatable secondary lamp is swivel mounted so as to be rotatable in an angle up to approximately 65°, and illuminates only at full extension.

3. The dual beam flashlight according to claim 1, including first wiring means configured such that only said primary headlamp is energized by utilizing the first light switch.

4. The dual beam flashlight according to claim 3, wherein said first light switch comprises a slide member located on said top region of the flashlight body.

5. The dual beam flashlight according to claim 1, including second wiring means configured such that only the rotatable secondary lamp is energized by rotating said lamp away from the recess of the flashlight body.

6. The dual beam flashlight according to claim 1, wherein the rotatable secondary lamp has a spring contact for energizing said lamp upon rotation of said rotatable secondary lamp away from the flashlight body.

7. The dual beam flashlight according to claim 6, wherein said spring contact has a rounded end ensuring smooth contact and smooth disconnection with the second energizing system.

8. The dual beam flashlight according to claim 1, including a detachable wrist strap situated proximate to a rear end and at said bottom region of the dual beam flashlight.

9. The dual beam flashlight according to claim 1, including independent batteries in each energizing source.

10. The dual beam flashlight according to claim 1, further including a hinged lens cap for the rotatable secondary lamp, and a hinged end cap attached to the flashlight body.

11. The dual beam flashlight according to claim 1, wherein the flashlight body has a flat rear end, whereby said flashlight body can stand upright for hands-free use.

12. The dual beam flashlight according to claim 1, including krypton bulbs for the fixed primary headlamp and the rotatable secondary rotatable lamp.

13. The dual beam flashlight according to claim 1, the flashlight body being fabricated from a plastic material.

14. The dual beam flashlight according to claim 13, wherein the flashlight body is made of a acrylonitrile-butadiene-styrene polymer, each lens for the primary headlamp and the rotatable secondary lamp is made of an acrylic polymer, and the slide switch is made of a polycarbonate polymer.

15. A dual beam flashlight comprising:

a flashlight body comprising a primary headlamp, a rotatable secondary lamp in a housing, a recess for the housing, a first light switch, a second light switch, a first energizing source, and a second energizing source;

the primary headlamp being located at a front end of the flashlight body and fixed in said flashlight body, said flashlight body having a top region and a bottom region;

the rotatable secondary lamp being encased in the housing which is rotatable, said housing being positioned completely in the recess in said bottom region and proximate to the front end of said flashlight body;

the first light switch positioned in the top region of the flashlight body, energizing only the primary headlamp from the first energizing source;

the second light switch energizing the rotatable secondary lamp only by the second energizing source when said rotatable secondary lamp in said housing is rotated out from the recess;

the rotatable secondary lamp having a spring contact, there further being a rounded end at one end thereof, ensuring smooth contact and smooth disconnection with the second energizing system, a bent end at an opposite end contacting the rotatable secondary lamp, and an intermediate pivoting loop, said spring contact energizing said rotatable secondary lamp upon rotation of the housing away from the flashlight body;

whereby a user of said dual beam flashlight can illuminate darkened areas from the lamps of the dual beam flashlight selected from the fixed primary headlamp, the rotatable secondary lamp, and both the fixed primary headlamp and the rotatable secondary lamp.

16. A dual beam flashlight comprising:

a flashlight body comprising a primary headlamp, a secondary lamp and reflector, a rotatable housing within which is mounted said secondary lamp and reflector, means defining a recess within said body for the rotatable housing with its said secondary lamp and reflector, switch means for actuating said headlamp and said secondary lamp, battery means for energizing said headlamp and said secondary lamp, and electrical circuit means interconnecting said switch means, said battery means and said headlamp and said secondary lamp, said body having a top region and a bottom region; and means rotatably mounting said rotatable housing on a horizontal axis defined in and through at least a portion of said flashlight body, between said top region and said bottom region, and adjacent an end of said recess means, said body having a major length, said flashlight body and said rotatable housing being dimensioned and configured such that said housing is rotatable from a first position aligned with said body major length and substantially within said recess so as to form a part of said flashlight body, said primary headlamp and said secondary lamp being aimed in the same general direction in said first position, to a second position downwardly and away from said body major length, said secondary lamp being aimed to project light in the same plane and away from said headlamp when said housing is in said second position.

17. The dual beam flashlight according to claim 16, wherein said light switch means comprise a slide member located on said top region of said flashlight body.

18. The dual beam flashlight according to claim 16, wherein said flashlight body is fabricated from a plastic material.

19. The dual beam flashlight according to claim 16, further comprising means confining rotation of said rotatable housing from said first position through an angle of no more than 90 degrees.

20. The dual beam flashlight according to claim 16, wherein the overall length of said rotatable housing is substantially less than said body major length.

* * * * *